US007059266B1

(12) United States Patent
Burlando

(10) Patent No.: US 7,059,266 B1
(45) Date of Patent: Jun. 13, 2006

(54) REFLECTIVE WARNING AND LOCATOR COLLAR FOR HYDRANTS, PYLONS AND SUPPORT POSTS

(76) Inventor: Albert A. Burlando, 2 Joy Dr., Hackettstown, NJ (US) 07840-9600

( * ) Notice: Subject to any disclaimer, the term of this patent is extended or adjusted under 35 U.S.C. 154(b) by 0 days.

(21) Appl. No.: 09/577,854

(22) Filed: May 25, 2000

Related U.S. Application Data

(60) Provisional application No. 60/140,739, filed on Jun. 25, 1999.

(51) Int. Cl.
*E03B 9/06* (2006.01)

(52) U.S. Cl. ..... 116/200; 116/209; 137/272

(58) Field of Classification Search ..... 116/200, 116/209, 28 R; 137/272; 359/543, 515, 532, 359/547, 552; D10/111
See application file for complete search history.

(56) References Cited

U.S. PATENT DOCUMENTS

| | | | | | |
|---|---|---|---|---|---|
| 2,175,565 | A | | 10/1939 | Blackman et al. | 359/543 |
| 2,175,567 | A | | 10/1939 | Blackman et al. | 359/543 |
| 2,327,742 | A | * | 8/1943 | Rosenberg | 211/131.1 |
| 2,424,269 | A | | 7/1947 | Doody | 248/475.1 |
| 2,610,548 | A | * | 9/1952 | Isenberg | 359/553 |
| 3,387,397 | A | * | 6/1968 | Buchanan et al. | 40/618 |
| 4,154,504 | A | * | 5/1979 | Mohs | 359/514 |
| 4,478,169 | A | | 10/1984 | Shrefler | 116/209 |
| 4,841,654 | A | * | 6/1989 | Hodgson et al. | 40/661.05 |
| 4,908,249 | A | | 3/1990 | Lines | 428/36.9 |
| 5,599,132 | A | * | 2/1997 | Hughes | 404/6 |
| 5,731,895 | A | | 3/1998 | Owczarzak et al. | 359/515 |
| 5,780,140 | A | * | 7/1998 | Nilsen | 428/172 |
| 5,837,350 | A | | 11/1998 | Jacobs | 428/195 |
| 6,260,507 | B1 | * | 7/2001 | Simpson et al. | 116/200 |
| 6,269,570 | B1 | * | 8/2001 | Miles | 40/607 |
| 6,558,011 | B1 | * | 5/2003 | Fritz | 359/552 |
| 6,758,160 | B1 | * | 7/2004 | Martin | 116/202 |

* cited by examiner

*Primary Examiner*—R A Smith
(74) *Attorney, Agent, or Firm*—Pitney Hardin LLP

(57) ABSTRACT

A reflective warning and locating collar for fire hydrants, pylons or support posts to improve their visibility and identity, the collar having a support member defined by a flexible extruded web having flanges along the longitudinal edges to define a channel slot for receipt of an elongate flexible reflective member in web form slidably receivable within the channel, the ends of the reflective member and support member having a plurality of alignable apertures for receipt of a fastening member.

6 Claims, 3 Drawing Sheets

REFLECTIVE WARNING AND LOCATOR COLLAR FOR HYDRANTS, PYLONS AND SUPPORT POSTS

Priority is hereby claimed to U.S. Provisional Patent Application 60/140,739, which was filed on Jun. 25, 1999.

BACKGROUND OF THE INVENTION

1. Field of the Invention

The present invention relates to the field of fire hydrants, and also to pylons and support posts found both on land and in water, and a reflective or fluorescent means to identify or warn of their location.

2. Description of the Prior Art

Fire hydrants are a part of every day life and in most communities they are located in spaced apart relationship in order to provide a source of water to fireman in fighting a fire within the proximity of the particular hydrant. Fire hydrants are recognized in our daily travels, but their exact location does not often register in our minds. The same holds true for fire fighters when responding to a fire when they visually identify the location of the nearest hydrant as a result of their bright color. However, in the hours of darkness and other periods of low visibility, the fire hydrants, even though brightly colored, may not be readily identifiable to the fire fighters and the inability to locate the fire hydrant may delay the commencement of the fire fighting activities and thus endanger not only property, but life.

In such situations of low visibility or darkness, in warm and temperate climates, a solution to the problem has been to embed in the concrete or asphalt proximate to the fire hydrant, a reflective or fluorescent member which is easily visible to the fire fighter for identifying the location of a fire hydrant.

This solution has not been available in colder climates which experience a winter period where snow may be prevalent which may cover the reflective or fluorescent identifier. Still further, in such climates, snow removal may have a deleterious affect on the reflective or fluorescent identifier embedded in the concrete or asphalt adjacent the fire hydrant such that its life span is limited.

Is Therefore there exists the need for a reflective or fluorescent member that can be easily secured to or about a fire hydrant which at night or low visibility situations will easily identify the location of the hydrant to the fire fighters.

The same type of an assembly can find application in night time, low visibility or low illumination situations with respect to pylons and supports in bodies of water, such as pylons supporting a duck blind, pylons or supports supporting a pier or wharf, and pylons or supports along traffic thoroughfares where there is little or no street lighting, such as country roads or the like. Further application may also be had to utility poles of aluminum, steel or concrete which line many unilluminated country roads.

OBJECTS OF THE INVENTION

An object of the present invention is to provide for a novel reflective and/or fluorescent member readily securable about a fire hydrant such that the reflective and/or fluorescent capabilities serves to identify the location of the fire hydrant to fire to fighters in low visibility situations.

Another object of the present invention is to provide for a novel reflective and/or fluorescent member which is readily securable about a fire hydrant and not facilly removable therefrom.

Another object of the present invention is to provide for a novel reflective and/or fluorescent member which is readily mountable about a pylon or support member partially submerged in a body of water to identify the location of the pylon or support member to water craft in low visibility situations.

A still further object of the present invention is to provide for a novel reflective and/or fluorescent member which is readily securable about a pylon or support, which pylon or support may be partially submerged in a body of water, the reflective and/or fluorescent member being constructed so as to be impervious to the deleterious affects of the body of water.

A still further object of the present invention is to provide for a novel reflective and/or fluorescent member which is readily securable about a utility pole, aluminum, steel or concrete street light pole, or pylon or other support which may be positioned proximate a thoroughfare and not easily visible in low visibility situations.

SUMMARY OF THE INVENTION

A warning and locator assembly for mounting about a fire hydrant or vehicle obstacle to aid in the warning or identifying of its location, the assembly having the flexible member having an extruded channel defining a slot for the slidable receipt of a substrate and laminated reflective material secured thereto, the reflective material, substrate and extruded channel having a plurality of cooperative apertures therethrough proximate the end of the extruded channel for receipt of a fastening means to secure the assembly in a collar like fashion about the circumference of a fire hydrant or vehicle obstacle.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
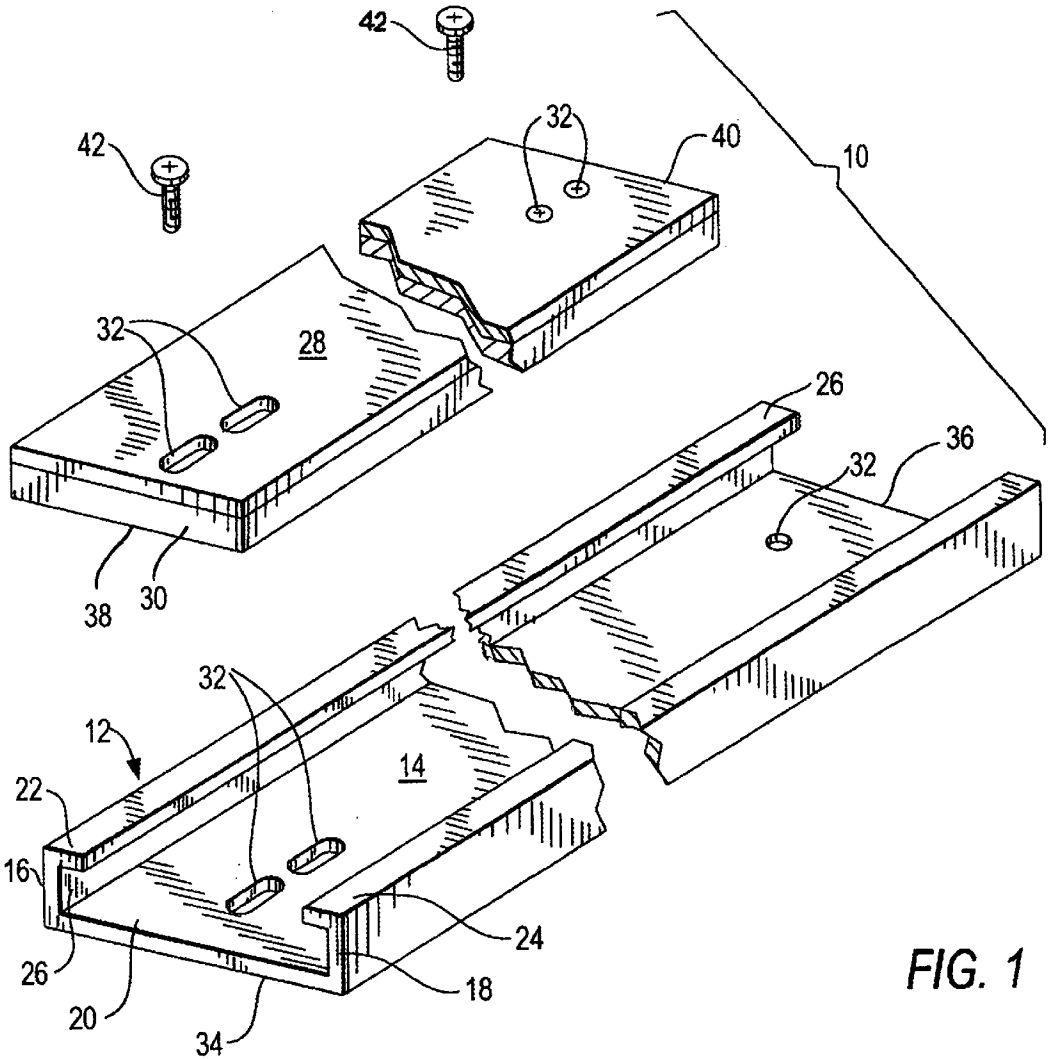
FIG. 1 is a prospective exploded view of the warning and locator collar in a planar mode.

FIG. 1 is a prospective exploded view of the warning and locator collar assembly 10. It is comprised of an extruded elongated channel 12 which is flexible and which is fabricated of a weather resistant polymer such as polyethylene or the like. Extruded channel 12 is defined by a web 14, depending flanges 16 and 18 which depend from first side 20 of web 14 and which terminate in inwardly turned fingers 22 and 24 respectively. This construction defines a slot 26 formed by web 14 and depending flanges 16 and 18 and inwardly turned flanges 22 and 24 for the slidable receipt of a reflective material 28 which may or may not be laminated to a substrate 30.

Extruded channel is flexible so that it may be formed into a collar about a fire hydrant or vehicle obstacle and the reflective material 28 and substrate 30 would be similarly flexible to allow for such circumscription about a fire hydrant or vehicle obstacle.

Extruded channel 12 and the reflective and substrate material 28 and 30 respectively, slidably receivable therein, have a plurality of alignable apertures or slots 32 therethrough proximate their respective ends 34, 36 and 38, 40 for the receipt of a fastening means 42. Depending upon the nature of the device or obstacle about which the locator and warning collar is circumscribed, the fastening means 42 may serve to fasten the two ends of the locator and warning collar 10 together or the fastening means 42 may serve to secure the opposing ends of the locator and warning strip 10 together and simultaneously penetrate the pylon or vehicle obstacle about which it is being circumscribed.

Figure 2:
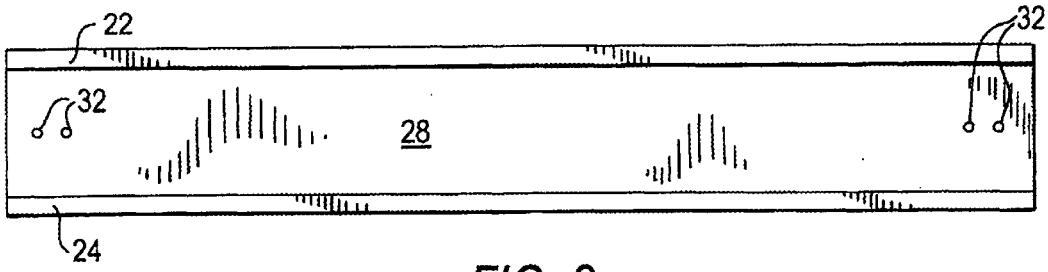
FIG. 2 is a top view of the warning and locator collar.
Figure 3:
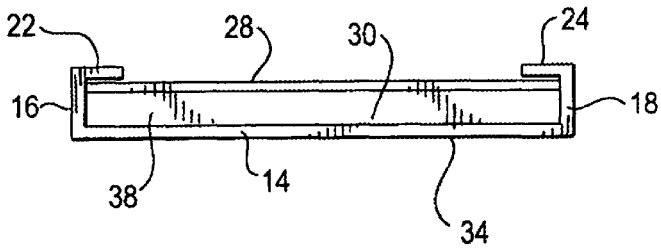
FIG. 3 is an end view of the warning and locator collar.

FIG. 2 is a top view of the warning and locator collar assembly 10 illustrating the slidable receipt of reflective material 28 and substrate 30 within slot 26. FIG. 3 is an end view of the warning and locator strip 10 with the reflective material 28 and substrate 30 positioned within slot 26.

Figure 4:
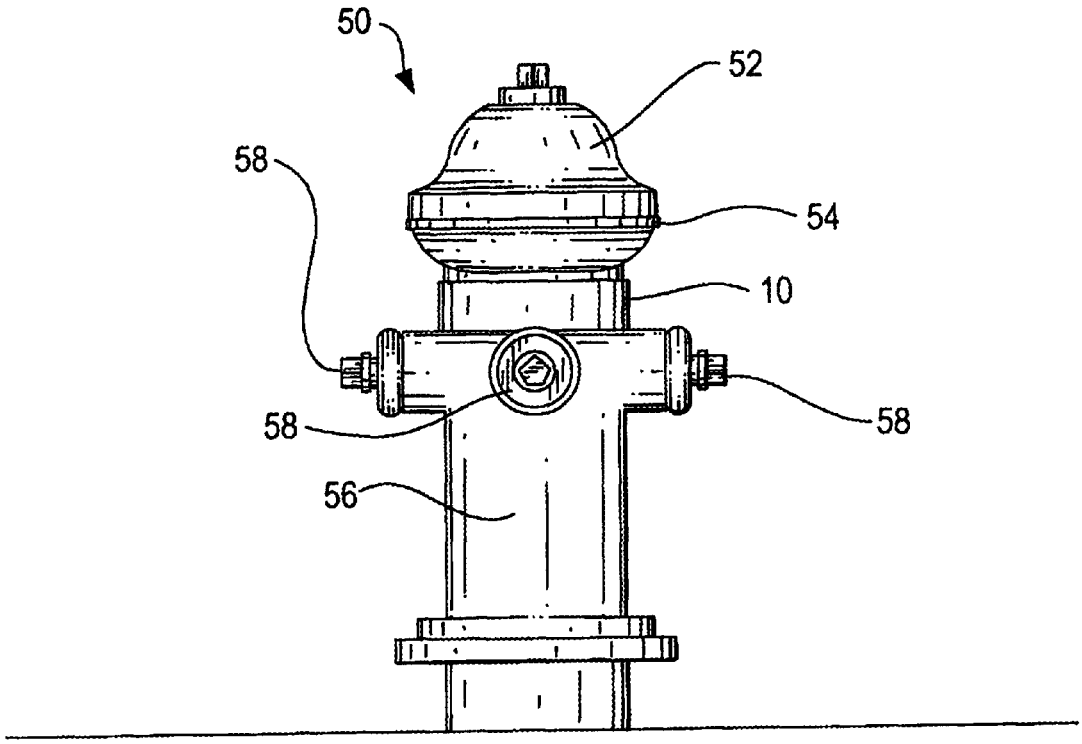
FIG. 4 is a front view of the warning and locator collar secured about a fire hydrant.

FIG. 4 is a front view of the warning and locator collar 10 secured about a fire hydrant 50 providing a visually reflective signal to fire fighters of the location of a fire hydrant. Warning and locator collar assembly 10 is particularly adapted for use on fire hydrants due to the shape of the fire hydrant 50. Fire hydrant 50 is characterized by a top 52 having a flange portion 54. Top 52 provides the fire fighter with access to the valve opening mechanism in order to commence the flow of water. About the cylindrical body 56 of fire hydrant 50 are a plurality of hose bib flanges 58, the covers of which are removable by the fire fighter in order to attach a fire hose. The warning and locator collar assembly 10 would be secured about fire hydrant 50 between its upper flange portion 54 and the plurality of hose bib flanges 58. The warning and locator collar assembly 10 would circumscribe the hydrant body 56 at this location and be secured with an aluminum rivet and end cap or other suitable securing means. The warning and locator collar assembly 10, positioned in such a fashion, is not easily removable from the hydrant 50 by unauthorized persons due to the difficulty in gaining access thereto as it is positioned between the top flange 54 and the hose bib flanges 58.

The reflective material 28 utilized in warning and locator collar assembly 10 may also be varied to serve as a further indicator to firemen. The normal color for identifying a hydrant which was active, that is capable of supply a source of water, is blue, and therefore active hydrants would have a warning and locator collar assembly 10 incorporating a blue reflective material 28. If a hydrant 50 was inactive, that is not capable of supplying water for whatever reason, it could be identified with a different reflective material 28 thereby identifying it to firemen as an inactive hydrant such that precious time is not wasted in attempting to secure fire hoses thereto. Additionally, a message stating "NOT IN SERVICE" or ownership identification can be screen printed to the reflective strip.

Figure 5:
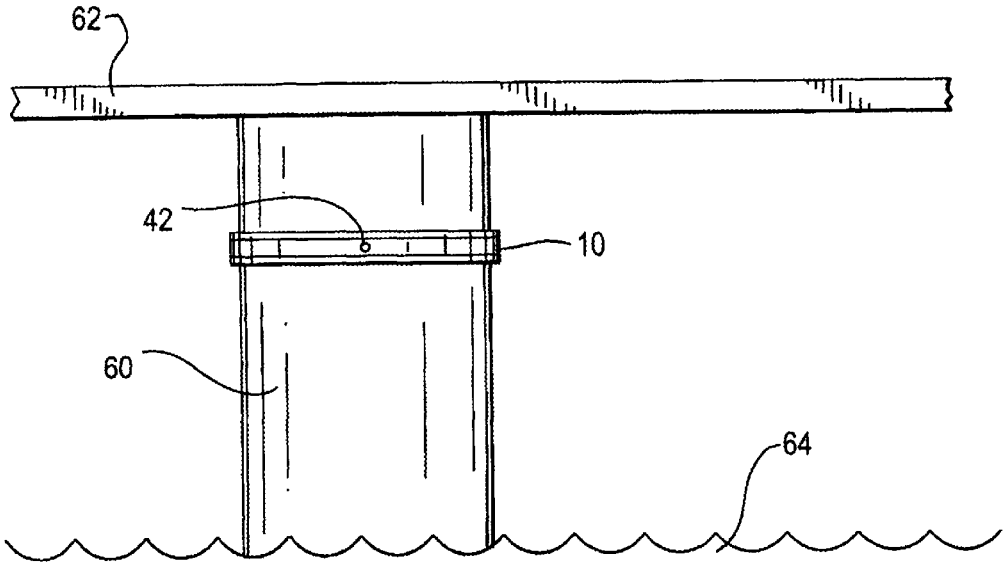
FIG. 5 is a front view of the warning and locator collar positioned about a partially submerged pylon.

FIG. 5 is a front view of the warning and locator collar assembly 10 secured to a vehicle obstacle 60. The vehicle obstacle 60 could be of many types of forms. For instance, it could represent a utility pole proximate the edge of an unlit roadway thus presenting a potential hazard or obstacle to a land based vehicle. Vehicle obstacle 60 could also be in the form of a pylon or pier support on a waterway. It is this latter type obstacle that is illustrated in FIG. 5 in the form of a partially submerged pylon or pier support 60 supporting a platform 62, support 60 being partially submerged in body of water 64. In this configuration, the warning and locator collar assembly 10 is wrapped about the pylon or pier support 60 so as to circumscribe its circumference and the fastening means 42 would be secured through apertures 32 to maintain the warning and locator strip assembly 10 in its circumscribed position. Depending upon the nature of the material constituting the pylon or pier support, the fastening means 42 may only be required to secure the ends of the warning and locator collar assembly 10 in order to maintain its position about the pylon or pier support 60. Alternatively, a fastening means may be used which not only secures the ends of the warning and locator collar assembly 10 in such a circumscribed position, but may also penetrate the pylon or pier support in order to maintain the circumscribed location of the warning and locator collar assembly 10.

The stratum 30 is not required with respect to the locator and warning assembly if the reflective material 28 is fabricated of a flexible, yet semi-rigid material. However in the preferred embodiment, the reflective material 28 is laminated to a substratum layer 30 which is flexible and semi-rigid and which is fabricated of materials which will be resistant to the weather and corrosion. In that regard, the substratum 30 could be comprised of a suitable polymer, or aluminum or stainless steel of suitable thickness to provide the flexibility for wrapping the assembly as heretofore disclosed.

While the present invention has been described with respect to the exemplary embodiments thereof, it will be recognized by those of ordinary skill in the art that many changes or modifications may be made without departing from the spirit and scope of the invention. Therefore it is manifestly intended that the invention be limited only by the scope of the claims and the equivalence thereof.

What is claimed is:

1. A reflective warning and locating collar for fire hydrants, pylons or support posts, said reflective warning and locating collar comprising:

a support member having an elongated, flexible, extruded web having a first side and a second side, defined by two parallel longitudinal edges and a first end and a second end, said web having flanges depending from said longitudinal edges of said first side of said web, said flanges terminating with inwardly turned second flanges parallel to said web thereby defining a channel between said web and said inwardly turned second flanges from said first end of said support member to said second end of said support member;

a reflective member comprised of an elongate flexible web slidably receivable and retainable within said channel, said reflective member also having a first end and a second end, said support member and said reflective member having a plurality of alignable apertures proximate respective said first and second ends for alignment and receipt of a fastening means so as to permit said support member and said reflective member to be circumscribably engaged about a fire hydrant, pylon or support post forming a reflective warning and locating collar.

2. The reflective warning and locating collar in accordance with claim 1 wherein said support member is fabricated from a weather resistant polymer.

3. The reflective warning and locating collar in accordance with claim 1 wherein said reflective member is bonded to a substrate, said substrate and said reflective member slidably receivable within said channel of said support member.

4. A fire hydrant having an identifiability member comprising:

a fire hydrant having a generally vertically tubular member extending upwardly from the ground and in communication with a source of water, a plurality of hose connections extending perpendicularly outwardly from said tubular vertical member, said hose connections having cap members affixed thereto and said tubular vertical member having a cap member affixed to a top end, said cap member incorporating a valve actuator, said identifiability member comprising a reflective warning and locating collar circumscribably engaged about said fire hydrants said reflective warning and locating collar comprising a support member having an elongated, flexible extruded web having a first side and a second side, defined by two parallel longitudinal edges and a first end and a second end, said web having flanges depending from said longitudinal edges of said first side of said web, said flanges terminating with inwardly turned second flanges parallel to said web thereby defining a channel between said web and said inwardly turned second flanges from said first end of said support member to said second end of said support member, a reflective member comprised of an elongate flexible web slidably receivable and retainable within said channel, said reflective member also having a first end and a second end, said support member and said reflective member having a plurality of alignable apertures proximate respective said first and second ends for alignment and receipt of a fastening means so as to permit said support member and said reflective member to be circumscribably engaged about said fire hydrant.

5. The fire hydrant in accordance with claim 4 wherein said reflective warning and locating collar support member is fabricated from a weather resistant polymer.

6. The fire hydrant in accordance with claim 4 wherein a second reflective warning and locating collar is positioned about said fire hydrant beneath said extending hose connections.

* * * * *